United States Patent [19]

Yuen

[11] 4,351,125

[45] Sep. 28, 1982

[54] TELEPHONE INDEX

[75] Inventor: Se-kit Yuen, Kowloon, Hong Kong

[73] Assignee: John Manufacturing Limited, Kowloon, Hong Kong

[21] Appl. No.: 251,773

[22] Filed: Apr. 7, 1981

[30] Foreign Application Priority Data

Apr. 9, 1980 [GB] United Kingdom ..... 8011669

[51] Int. Cl.[3] ..... B42F 17/34

[52] U.S. Cl. ..... 40/381

[58] Field of Search ..... 40/375, 381, 380

[56] References Cited

U.S. PATENT DOCUMENTS

| | | | |
|---|---|---|---|
| 3,167,371 | 1/1965 | Parcher et al. | 40/381 |
| 3,276,155 | 10/1966 | Conia | 30/375 |
| 3,292,286 | 12/1966 | Baumer | 40/375 |
| 3,423,862 | 1/1969 | Koller | 40/375 |
| 4,070,776 | 1/1978 | Mitsuhashi | 40/382 |

FOREIGN PATENT DOCUMENTS

| | | | |
|---|---|---|---|
| 2059351 | 4/1981 | United Kingdom | 40/388 |

*Primary Examiner*—Gene Mancene
*Assistant Examiner*—Wenceslao J. Contreras
*Attorney, Agent, or Firm*—Charles E. Temko

[57] ABSTRACT

A telephone index comprises a box stand on which a telephone can be placed and an index comprising a stack of cards in a drawer, any selected one of which can be presented for inspection upon pressing the respective one of a plurality of buttons. Levers are mounted in an upper part of the box and extend from the front towards the rear thereof, the levers are pivotably mounted about a common transverse and generally horizontal axis located at a position forward of the push buttons and each co-operates with a respective one of the push buttons such that pressing any one of the push buttons depresses a rearwardly extending arm of a respective one of the levers to move a downwardly extending projection at the rear end of the lever downwardly into engagement with an abutment surface and raises a forwardly extending arm of the lever against the bias of a spring to trip a drawer catch to allow the spring biassed drawer to open. Each of the cards has at least one extension at its rear end, the extensions having apertures therein through which selected ones of said downwardly extending projections can pass to secure the cards against outward movement with the drawer.

3 Claims, 10 Drawing Figures

TELEPHONE INDEX

The invention relates to a telephone index, that is to say a combination of a stand on which a telephone can be placed and an index comprising a stack of cards, any selected one of which can be presented for inspection upon pressing the respective one of a plurality of buttons. The stand is in the form of a box with a sliding drawer which is spring loaded for outward movement upon depression of any one of the buttons and presents the particular card selected as the upper card in the drawer, any cards of the stack which are located at a position above the selected card being retained in the box and not moving outwardly with the drawer so as not to obscure the particular card selected.

The invention has among its objects to provide a telephone index of the kind referred to which has a positive retaining and entraining action for the cards such that reliable operation is assured.

According to the invention there is provided a telephone index of the kind referred to in which a plurality of levers are mounted in an upper part of the box and extend from the front towards the rear thereof, the levers are pivotably mounted about a common transverse and generally horizontal axis located at a position forward of the push buttons and each co-operates with a respective one of the push buttons such that pressing any one of the push buttons depresses a rearwardly extending arm of a respective one of the levers to move a downwardly extending projection at the rear end of the lever downwardly into engagement with an abutment surface and raises a forwardly extending arm of the lever against the bias of a spring to trip a drawer catch to allow the spring biassed drawer to open, and each of the cards has at least one extension at its rear end, the extensions having apertures therein through which selected ones of said downwardly extending projections can pass to secure the cards against outward movement with the drawer.

Preferably the drawer has upstanding entraining projections at the sides thereof and the cards each have portions cut out to allow the cards to engage said entraining projections, thereby to entrain for movement with the drawer a selected one of the cards and all cards of the stack below said selected one.

It is only necessary to retain in the drawer the card immediately above the card selected since all or any cards thereabove will rest on the card immediately above the card selected and will not tend to move outwardly with the drawer.

To reduce frictional drag tending to retain entrained cards in the box and to assist return of the extensions of the cards not retained in the box onto the abutment surface upon re-closing of the drawer, a rear portion of the deck of the drawer on which the cards lie is provided with longitudinally extending alternating ribs and grooves, a freely slidable intermediate member has its upper surface of the same form as said rear portion of the deck and its under surface grooved to receive the ridges on said rear portion of the deck, and the front edge of the abutment surface and the front edge of the intermediate member have projecting tongues which lie in the grooves of the intermediate member and the grooves of said rear portion of the deck respectively.

Preferably the intermediate member has laterally extending projections at its front end to engage in grooves in upstanding side walls of the drawer, the rear ends of said grooves being closed to prevent disengagement of said intermediate member from the drawer.

Preferably the abutment surface has recesses therein to receive the downwardly extending projections of the levers and the downwardly extending projections have their free ends bent around rearwardly.

A forward portion of the deck of the drawer on which the cards lie may include recesses for a memo pad and a writing instrument and all the cards have one of the extensions thereon with an aperture therein at a common position so that depressing the press button which operates the lever having the downwardly extending projection at said common position retains all the cards in the drawer to give access to the memo pad and writing instrument when the drawer moves outwardly.

The invention is diagrammatically illustrated by way of example in the accompanying drawings, in which.

Figure 1:
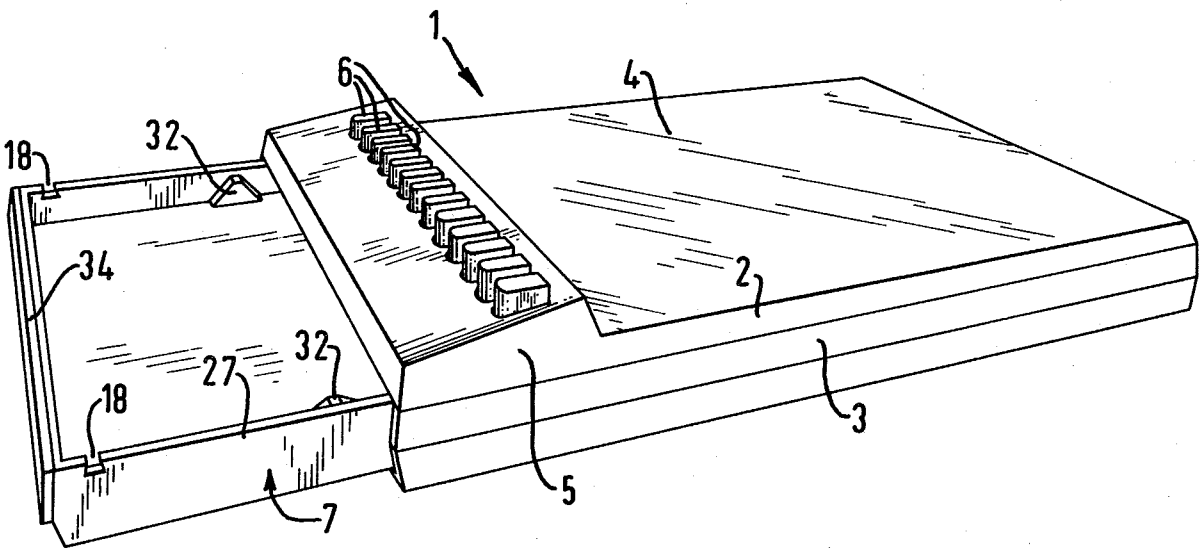
FIG. 1 is a perspective view of a telephone index according to the invention with its drawer partially open.
Figure 2:
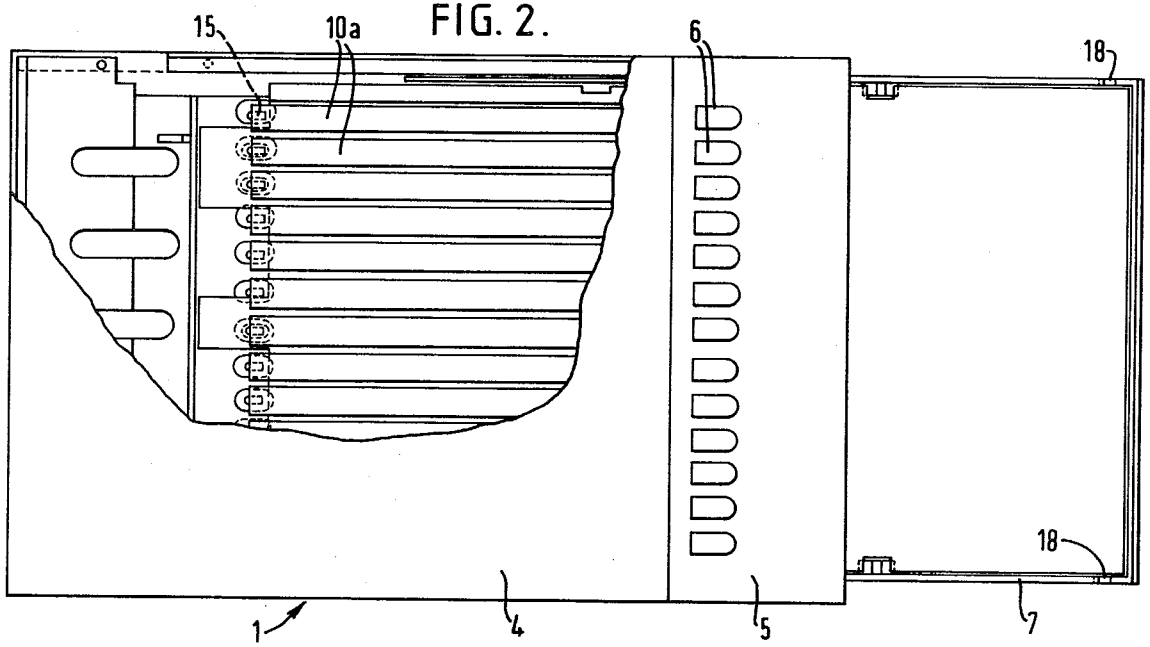
FIG. 2 is a plan view of the telephone index of FIG. 1 with a portion of the top wall cut away to show internal details.
Figure 3:
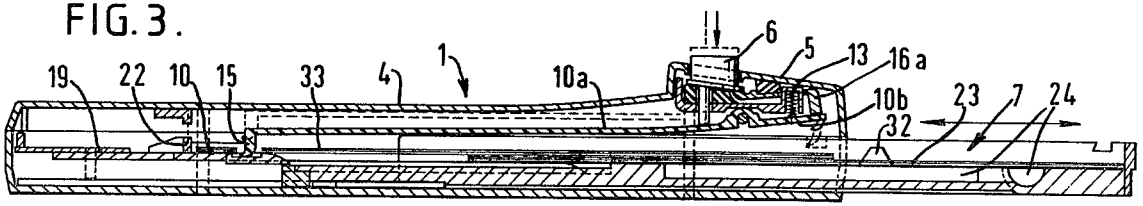
FIG. 3 is a sectional side view corresponding to FIG. 2.
Figure 4:
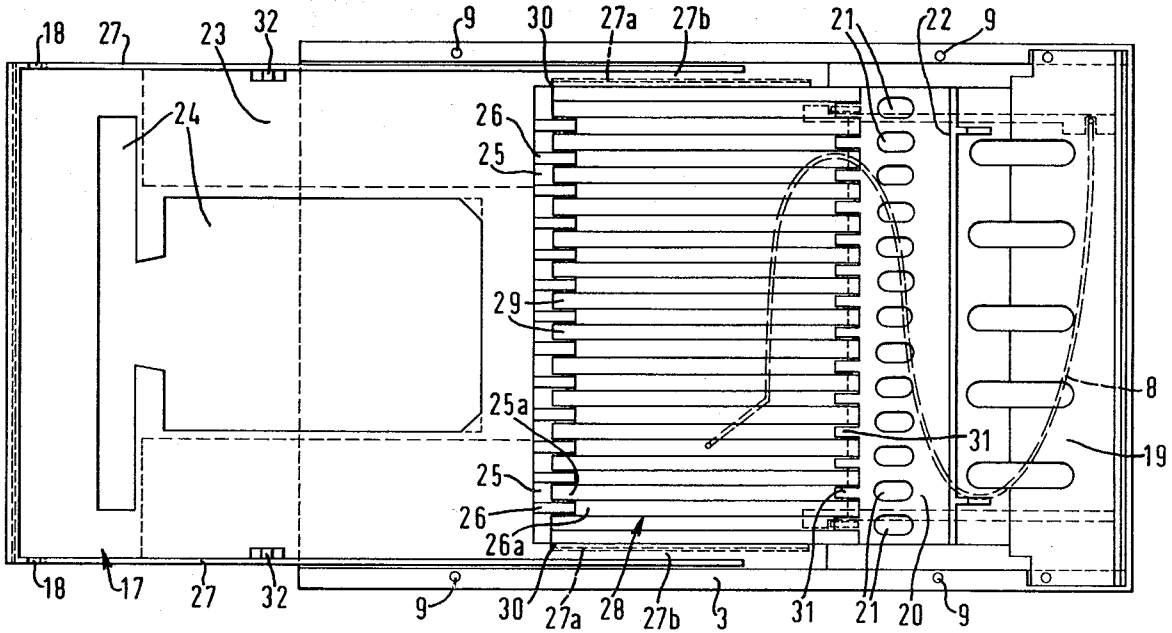
FIG. 4 is a plan view of a lower portion of the box of the telephone index of FIGS. 1 to 3.
Figure 5:
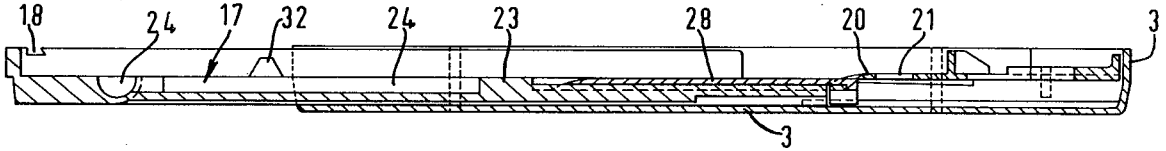
FIG. 5 is a sectional side view corresponding to FIG. 4.
Figure 6:
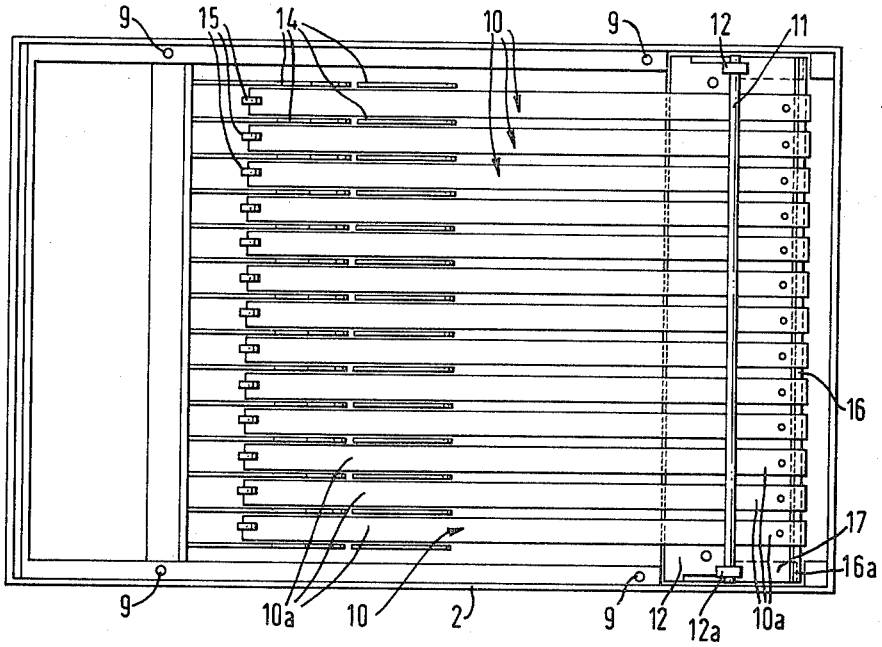
FIG. 6 is an underneath plan view of the upper part of the box of the telephone index of FIGS. 1 to 5.
Figure 7:
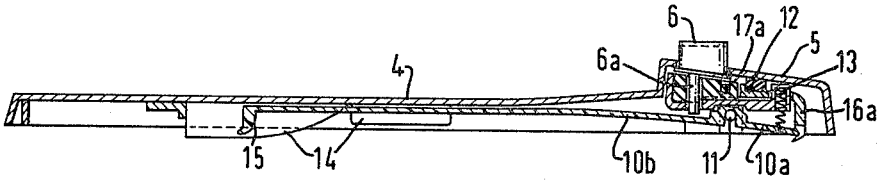
FIGS. 7 and 8 are sectional views corresponding to FIG. 1 showing respectively one of the levers in a non-operated and in an operated position.
Figure 8:
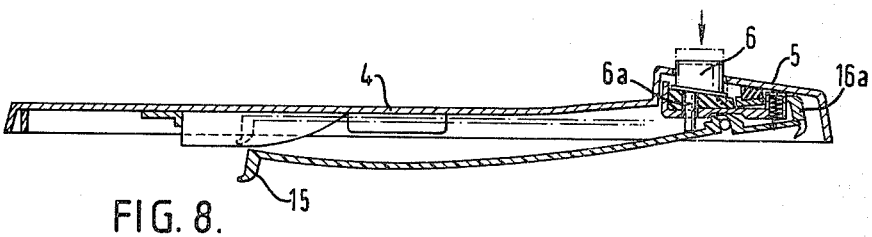

Referring to the drawings, a telephone index has a box-like housing 1 comprising an upper shell 2 and a lower shell 3, a flat upper surface 4 on which a telephone can be stood, a raised portion 5 at the front of the upper surface 4 and a row of push buttons 6 in the raised portion 5. A drawer 7 is slidably mounted in the housing 1 and is biassed for outward movement by a spring 8, FIG. 4. The shells 2 and 3 can be secured together by screws passing upwardly through apertures 9.

A plurality of levers 10, as shown thirteen levers 10 i.e. one for each of the push buttons 6, are pivotally mounted in the upper shell 2 by a pivot rod 11 mounted at its ends in lugs **12*a* of a mounting block 12 on the upper shell 2. The rod 11 is located forwardly of the push buttons 6 so that depressing one of the push buttons 6 presses a downwardly projecting rod portion 6*a* of the button 6 downwardly to press a long, rearwardly extending arm 10*a* of the respective lever 10 downwardly and a short, forwardly extending arm 10*b* of the lever 10 upwardly against the bias of a respective spring 13 located in a respective bore in the mounting block 12. Guide and guard webs 14 project from the shell 2 between the arms 10*a*. Each arm 10*a* has a downwardly extending projection 15** at its rear end with the tip thereof bent around rearwardly.

Forwardly of the springs 13, a transverse bar 16 is mounted on rearwardly extending arms 17 which have trunnions **17*a* mounted in recesses in the upper face of the mounting block 12. Upward movement of any one of the arms 10*b* presses the transverse bar 16 upwardly to disengage drawer catches 16*a* at the ends of the transverse bar from recesses 18 in side walls of the drawer 7 thereby to release the drawer 7 for outward movement under the bias of the spring 8**.

The lower shell 3 has a fixed portion 19 at its rear end including an abutment surface 20, the abutment surface 20 having recesses 21 therein. Each recess 21 is located beneath a respective one of the downwardly extending projections 15 of the levers 10 such that the projection 15 will engage therein when the respective button 6 is depressed. A vertical stop wall 22 is provided on the fixed portion 19.

The drawer 7 has a deck 23 with a shaped recess 24 in its forward part to receive a memo pad (not shown) and a writing instrument (also not shown). A rear portion of the deck 23 has alternating longitudinally extending grooves 25 and ribs 26. The drawer has side walls 27 in which the recesses 18 are provided.

An intermediate member 28 has a top surface with grooves **25*a* and ribs 26*a* in similar manner to the rear portion of the deck 23, the grooves 25*a* being longitudinally aligned with the grooves 25, and forwardly projecting tongues 29 at its front edge engaged in the grooves 25. The grooves 25 and ribs 26 are at a lower level than the forward part of the deck 23 such that the top surface of the ribs 26*a* is approximately at the same level as the forward part of the deck 23. Laterally extending projections at positions 30 project from the intermediate member 28 to engage in grooves 27*a* in side wall portions 27*b* at the rear part of the drawer 7. The forward edge of the abutment surface 20 has tongues 31 which engage in the grooves 25*a* of the intermediate member 28**.

Inverted V-shaped projections 32 are provided adjacent the side walls of the drawer 7.

Figure 10:
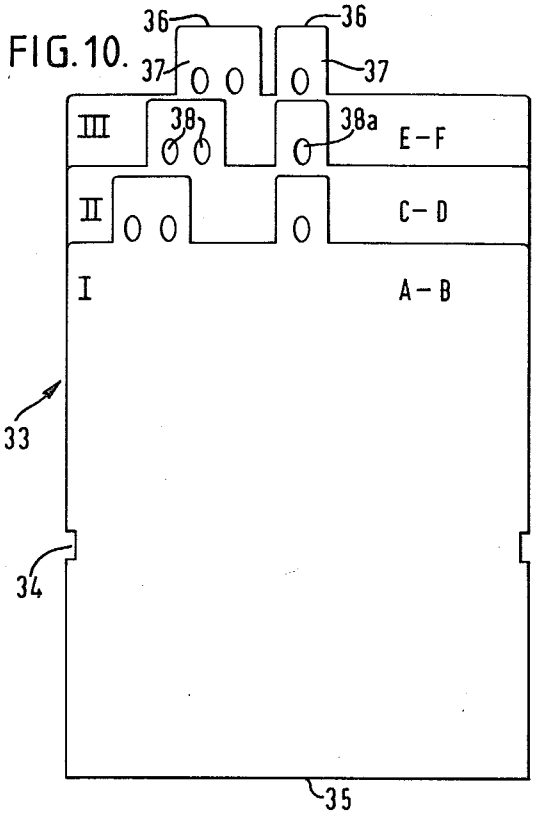
FIGS. 9 and 10 show the configuration of cards of the telephone index of FIGS. 1 to 8.
Figure 9:
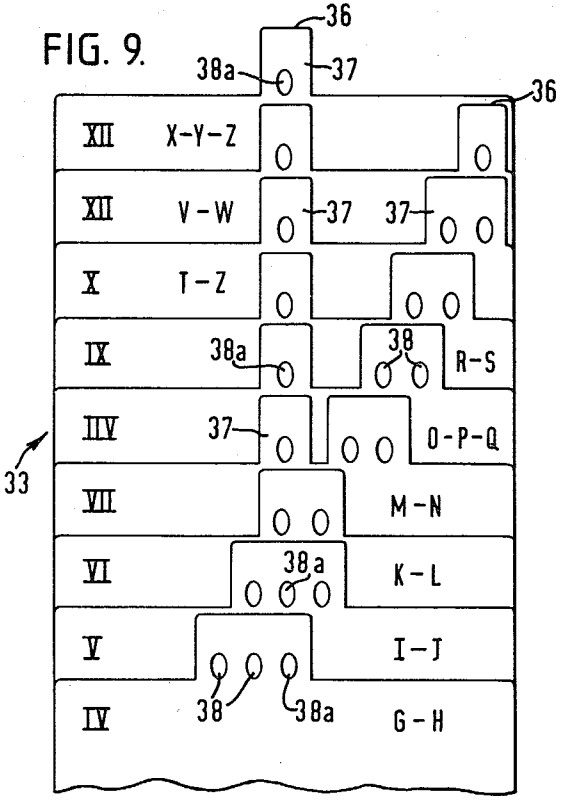

Twelve cards 33, FIGS. 9 and 10, lie on the deck 23 of the drawer and in the closed position of the drawer have cut outs 34 in their side edges engaged over the projections 32, their forward edges 35 located adjacent a front wall 34 of the drawer 7 and the rear edges 36 of extensions 37 at their rear ends located against the vertical stop wall 22 of the lower housing shell 3. Apertures 38 in the extensions 37 are in vertical alignment with the recesses 21 in the abutment surface 20. The configurations of the extensions 37 of the cards 33 are shown in FIGS. 9 and 10.

All have an extension 37 with an aperture **38*a* at a middle position in their width. The buttons 6 are labelled from left to right (as viewed from the front) according to cards I to XII i.e. lefthand button corresponds to card I, except that the middle button shows a symbol for the memo pad. Pressing any button will engage the respective projection 15 in the aperture 38 of the card immediately above the required card and retain that card and all those thereabove in the housing when the drawer 7 slides to an open position on release of the catches 16*a* from the recesses 18 in the drawer. Pressing the middle button will engage the respective projection 15 in the apertures 38*a*** of all the cards to retain all the cards and give access to the memo pad and writing instrument.

What is claimed is:

1. In a telephone index, comprising a stand on which a telephone may be placed and an index comprising a stack of cards, any selected one of which said cards can be presented for inspection upon pressing the respective one of a plurality of buttons, wherein said stand is in the form of a box, a drawer is slidable in said box and is spring-loaded for outward movement upon depression of any one of said plurality of buttons to present the particular one of said cards selected as the upper card in said drawer, any of said cards of said stack which are located at a position above said particular one of said cards selected being retained in said box and not moving outwardly with said drawer, the improvement comprising: a plurality of levers mounted in an upper part of said box, extending from the front toward the rear thereof, said levers being pivotally mounted about a common transverse and generally horizontal axis located at a position forwardly of said plurality of push buttons, each having an arm extending forwardly of the pivot axis and an arm extending rearwardly of the pivot axis with a downwardly extending projection at its rear end and each cooperating with a respective one of said push buttons such that pressing any one of said push buttons depresses said rearwardly extending arm of the respective one of said levers to move said downwardly extending projection thereof downwardly into engagement with a fixed abutment surface within said box and raises said forwardly extending arm thereof against the bias of a spring to trip a drawer catch to allow said spring biased drawer to open, and each of said cards having at least one extension at a rear end thereof, said extensions having apertures therein through which selected ones of said downwardly extending projections can pass to secure said cards against outward movement with said drawer; said drawer having upstanding entraining projections at the sides thereof and said cards each having portions cut out to allow said cards to engage said entraining projections, thereby to entrain for movement with said drawer a selected one of said cards and all of said cards of said stack below said selected one of said cards; and wherein to reduce frictional drag tending to retain entrained ones of said cards in said box and to assist return of said extensions of said cards not retained in said box onto said abutment surface upon re-closing of said drawer, a rear portion of said deck of said drawer, on which said rear portion said cards lie, is provided with longitudinally extending alternating ribs and grooves, and a freely slidable intermediate member is provided having an upper surface of the same form as said rear portion of said deck and having an undersurface thereof grooved to receive said ribs on said rear portion of said deck, the front edge of said abutment surface and the front edge of said intermediate member having projecting tongues which lie in said grooves of said intermediate member and said grooves of said rear portion of said deck, respectively.

2. A telephone index as claimed in claim 1, wherein said drawer has upstanding side walls with grooves therein and said intermediate member has laterally extending projections at its front end to engage in said grooves in said upstanding side walls of said drawer, the rear ends of said grooves being closed to prevent disengagement of said intermediate member from said drawer.

3. The telephone index as set forth in claim 2, wherein said abutment surface has recesses therein to receive said downwardly extending projections of said levers and said downwardly extending projections have their free ends bent around rearwardly.

* * * * *